US010668602B2

(12) United States Patent
Ishibashi

(10) Patent No.: US 10,668,602 B2
(45) Date of Patent: Jun. 2, 2020

(54) IMPACT ROTARY TOOL

(71) Applicant: Panasonic Intellectual Property Management Co., Ltd., Osaka (JP)

(72) Inventor: Takechika Ishibashi, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 246 days.

(21) Appl. No.: 15/454,298

(22) Filed: Mar. 9, 2017

(65) Prior Publication Data

US 2017/0259411 A1 Sep. 14, 2017

(30) Foreign Application Priority Data

Mar. 10, 2016 (JP) ..... 2016-047517

(51) Int. Cl.
*B25B 21/02* (2006.01)

(52) U.S. Cl.
CPC ..... *B25B 21/02* (2013.01); *B25B 21/026* (2013.01)

(58) Field of Classification Search
None
See application file for complete search history.

(56) References Cited

U.S. PATENT DOCUMENTS

2014/0367132 A1* 12/2014 Tanaka ..... B25B 21/026 173/93

FOREIGN PATENT DOCUMENTS

| | | |
|---|---|---|
| CN | 104227635 A | 12/2014 |
| EP | 2 813 325 A2 | 12/2014 |
| JP | 2014-240108 A | 12/2014 |

OTHER PUBLICATIONS

Extended Search Report issued in corresponding European Patent Application No. 17159467.4, dated Sep. 7, 2017.
Chinese Office Action issued in corresponding Chinese Patent Application No. 201710137542.7, dated Jul. 3, 2018, with English Translation.

* cited by examiner

*Primary Examiner* — Hemant Desai
*Assistant Examiner* — Tanzim Imam
(74) *Attorney, Agent, or Firm* — McDermott Will & Emery LLP

(57) ABSTRACT

An impact rotary tool includes: a driver; a spindle rotated by the driver; a primary hammer rotatable about an axis of rotation of the spindle and movable in a direction of the axis of rotation; a secondary hammer accommodating the primary hammer and rotatable integrally with the primary hammer; and an anvil applied with rotary stroke force by the primary hammer. An engaging pin is engaged with the primary hammer and the secondary hammer, integrally rotates the primary hammer and the secondary hammer, and allows the primary hammer to move in the direction of the axis of rotation. An elastic member is disposed in an annular groove formed in a circumferential direction on the inner peripheral surface of the secondary hammer and limits movement of the engaging pin.

5 Claims, 7 Drawing Sheets

21

IMPACT ROTARY TOOL

CROSS-REFERENCE TO RELATED APPLICATIONS

This application is based upon and claims the benefit of priority of Japanese Patent Application Number 2016-47517, filed on Mar. 10, 2016, the entire contents of which are hereby incorporated by reference.

BACKGROUND

1. Field of the Disclosure

The disclosure relates to an impact rotary tool.

2. Description of the Related Art

Japanese Unexamined Patent Application Publication No. 2014-240108 discloses an impact wrench including a spindle rotated by a driver, an anvil disposed anterior to the spindle in an axial direction of rotation of the spindle, and a rotary stroke mechanism that converts rotation of the spindle into rotary stroke and transfers the rotary stroke to the anvil. The rotary stroke mechanism includes a primary hammer rotatable about the axis of rotation of the spindle and movable in the axial direction and a secondary hammer including a cylindrical portion that accommodates the primary hammer, is inserted with the spindle, and rotates integrally with the primary hammer.

In the impact wrench disclosed in Japanese Unexamined Patent Application Publication No. 2014-240108, each of the primary hammer and the secondary hammer includes four grooves parallel to the axis of rotation. The grooves of the primary hammer are engaged with needle rollers fitted in the grooves of the secondary hammer.

These needle rollers allow the primary hammer and the secondary hammer to integrally rotate and the primary hammer to move along the needle rollers in the axial direction. To prevent the needle rollers provided to the secondary hammer from falling, a C-letter shaped stopper ring is attached to an outer periphery of the secondary hammer at a rear end side thereof.

In the impact rotary tool including the primary hammer and the secondary hammer, if a position of the needle roller engaged with both of them moves or comes off from the secondary hammer, this may lead to malfunction of the main body of the tool. Therefor the needle roller is desired to be held at a predetermined position.

SUMMARY

One aspect of the present invention has been devised in consideration to such circumstances. An object of one aspect of the present invention is to provide technique to stably hold an engaging pin that engages with a primary hammer and a secondary hammer in an impact rotary tool including the primary hammer and the secondary hammer.

In order to solve the above issue, an impact rotary tool of an embodiment of the present invention includes: a driver; a spindle rotated by the driver; a primary hammer rotatable about an axis of rotation of the spindle and movable in a direction of the axis of rotation; a secondary hammer accommodating the primary hammer and rotatable integrally with the primary hammer; and an anvil applied with rotary stroke force by the primary hammer. This impact rotary tool includes an engaging pin that is engaged with the primary hammer and the secondary hammer, integrally rotates the primary hammer and the secondary hammer, and allows the primary hammer to move in the direction of the axis of rotation and an elastic member that limits movement of the engaging pin.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

One aspect of the present invention will now be described by reference to the preferred embodiments. This does not intend to limit the scope of one aspect of the present invention, but to exemplify the teachings.

An impact rotary tool of an embodiment includes a spindle rotated by a driver, an anvil disposed anterior to the spindle in an axial direction of rotation of the spindle, and a rotary stroke mechanism that converts rotation of the spindle into rotary stroke and transfers the rotary stroke to the anvil. The rotary stroke mechanism includes a primary hammer rotatable about the axis of rotation of the spindle and movable in the axial direction and a secondary hammer including a cylindrical portion that accommodates the primary hammer, is inserted with the spindle, and rotates integrally with the primary hammer. The rotary stroke mechanism has a function to cause the primary hammer to be engaged with the anvil by impact and to rotate the anvil around the axis. The impact rotary tool of the embodiment will be described below with reference to the drawings.

Figure 1:
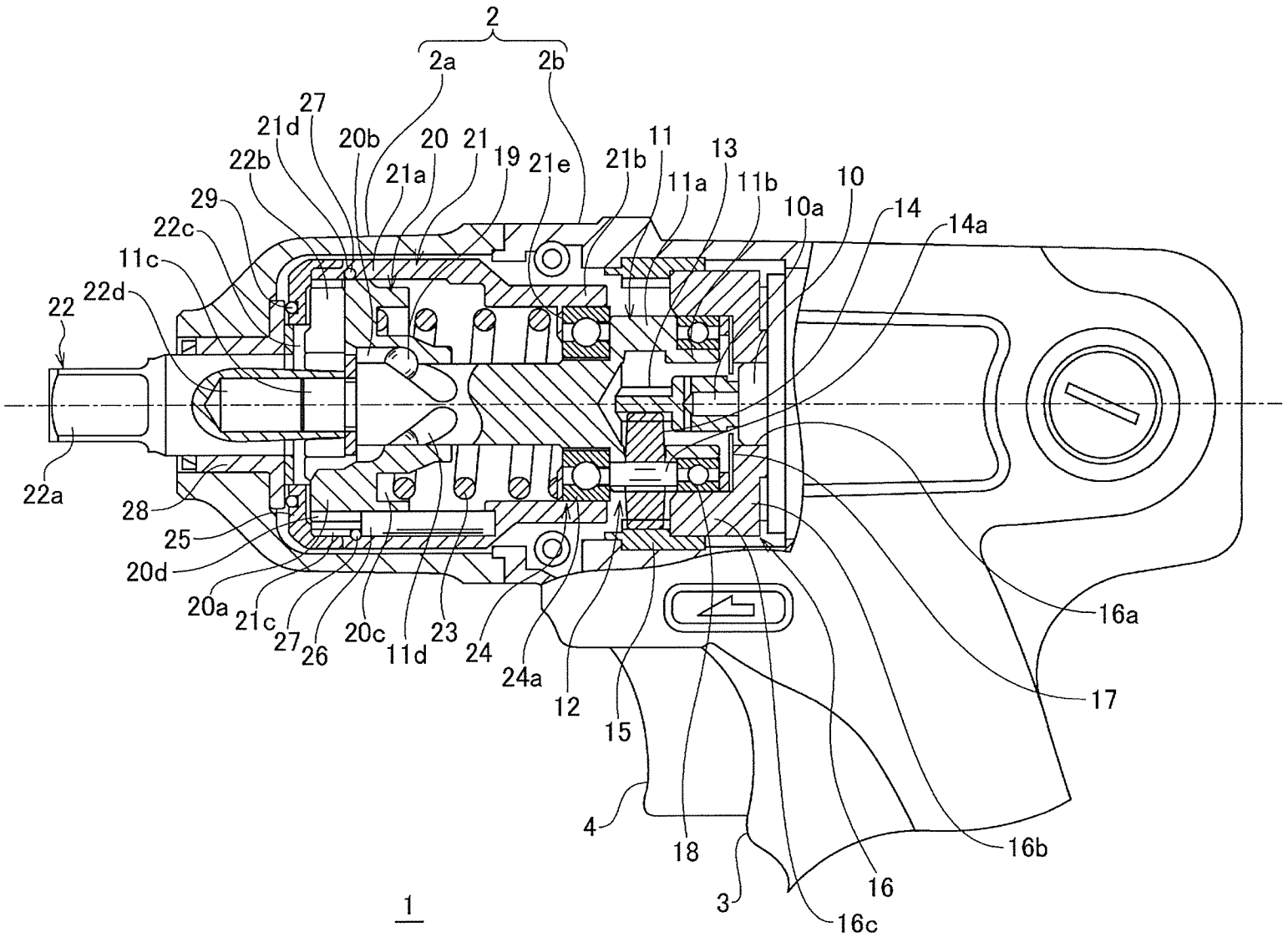
FIG. 1 is a schematic cross-sectional view of the main part of an impact rotary tool according to an embodiment.
Figure 2:
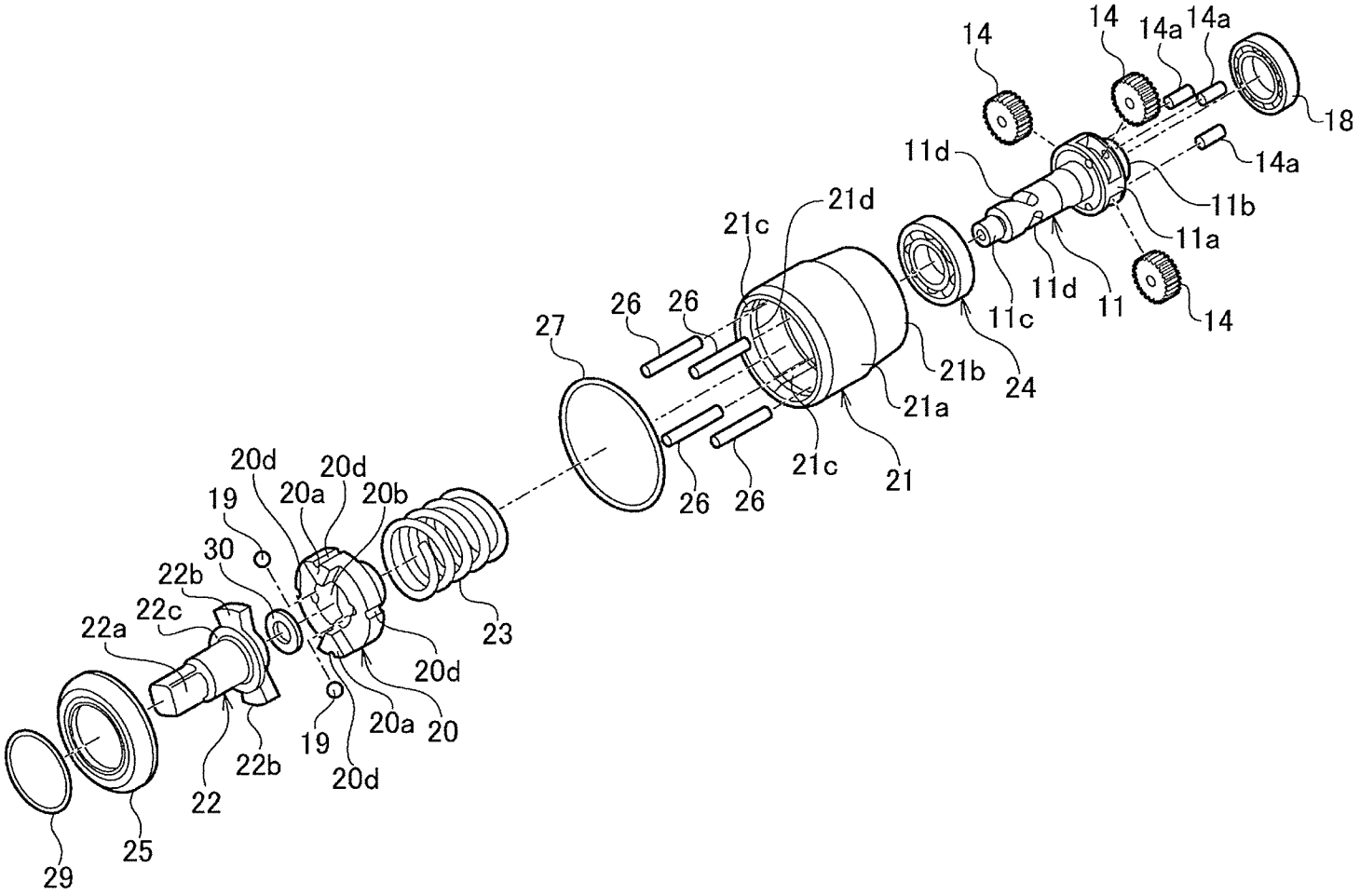
FIG. 2 is an exploded perspective view of components of the impact rotary tool according to the embodiment.

FIG. 1 is a schematic cross-sectional view of the main part of an impact rotary tool according to an embodiment. In FIG. 1, an upper cross-section and a lower cross-section with respect to an axis of rotation illustrated in an alternate long and short dash line in FIG. 1 illustrate cross-sections taken along different planes for convenience of descriptions. FIG. 2 is an exploded perspective view of components of the impact rotary tool according to the embodiment. An impact rotary tool 1 of the embodiment has a function to apply rotary stroke impact to a bolt, a nut, or the like. A rotary stroke mechanism of the impact rotary tool 1 is implemented mainly by a primary hammer 20, a secondary hammer 21, and a spring member 23 and further includes a part of structures of a spindle 11 and an anvil 22.

The impact rotary tool 1 includes a housing 2. The housing 2 includes a front housing 2*a* made of aluminum disposed on a front side and a rear housing 2*b* made of synthetic resin disposed on a rear side. The front housing 2*a* and the rear housing 2*b* may be fixed by a plurality of screws.

An upper portion of the rear housing 2*b* and the front housing 2*a* together form a body portion of the impact rotary tool 1. The body portion of the housing forms an empty space for accommodating various components such as a driver 10 that is a motor. A lower portion of the rear housing 2*b* forms a gripping portion 3 for a user to hold. A front side of the gripping portion 3 is provided with an operation switch 4 operated by a user and a lower end portion of the gripping portion 3 is provided with a battery that supplies power to the driver 10.

In the body portion of the housing, a driving shaft 10*a* of the driver 10 is connected to the spindle 11 via a power transmission mechanism 12. The power transmission mechanism 12 includes a sun gear 13 press-fitted and fixed to the driving shaft 10*a*, three planetary gears 14 meshing with the sun gear 13, and an internal gear 15 meshing with the planetary gears 14. The internal gear 15 is fixed to an inner peripheral surface of the rear housing 2*b*.

A spacer 16 is a ring-shaped member including a penetrating opening 16*a* in the center and is formed by a hollow disc 16*b* forming the penetrating opening 16*a* and a ring-shaped wall 16*c* extending forward from an edge of the hollow disc 16*b*. The ring-shaped wall 16*c* forms an opening having a diameter larger than that of the penetrating opening 16*a*. A front end side of the ring-shaped wall 16*c* is fixed to a rear end side of the internal gear 15. This allows the spacer 16 to be fixed on the inner peripheral surface of the rear housing 2*b* via the internal gear 15.

In the penetrating opening 16*a* of the spacer 16, an outer peripheral surface of the driver 10 is fitted and fixed to. In an inner peripheral surface of the ring-shaped wall 16*c* of the spacer 16, a bearing 18 rotatably supporting the spindle 11 is fitted. Referring to FIG. 2, the three planetary gears 14 are disposed inside a protruding portion 11*a* of the spindle 11. The planetary gears 14 are rotatably supported by support shafts 14*a* attached to the protruding portion 11*a*. A rear end portion 11*b* of the protruding portion 11*a* is fitted in and supported by the bearing 18. A washer 17 is provided between a front surface of the hollow disc 16*b* and an outer ring of the bearing 18.

In the power transmission mechanism 12 configured in the above manner, rotation of the driver 10 is decelerated based on a ratio of the number of teeth of the sun gears 13 and the number of teeth of the internal gears 15 and rotation torque thereof is increased. This allows the spindle 11 to be driven with a low speed and high torque.

A front side forward from the protruding portion 11*a* of the spindle 11 is formed into a columnar shape and a projection portion 11*c* with a smaller diameter is formed coaxially with the axis of the spindle 11 at a tip thereof. The projection portion 11*c* is rotatably inserted in a hole 22*d* having a columnar inner space formed at a rear portion of the anvil 22.

An outer periphery of the spindle 11 is mounted with the primary hammer 20 made of steel, having substantially a disc shape, and formed with a through hole in the center portion thereof. A front surface of the primary hammer 20 is formed with a pair of nails 20*a* protruding toward the anvil 22. The primary hammer 20 is attached to the spindle 11 such that the primary hammer 20 is rotatable about the axis of rotation of the spindle 11 and movable in the direction of the axis of rotation of the spindle 11, that is, forward and backward. This allows the primary hammer 20 to apply rotary stroke force to the anvil 22.

The rotary stroke mechanism of the impact rotary tool 1 includes, as described above, the spindle 11, the primary hammer 20, the secondary hammer 21, the anvil 22, and the spring member 23. The spindle 11 includes two first cam grooves 11*d* on an outer peripheral surface thereof. The primary hammer 20 includes two second cam grooves 20*b* on an inner peripheral surface of the through hole. While the primary hammer 20 is mounted to the outer periphery of the spindle 11, steel balls 19 are disposed between the first cam grooves 11*d* and the second cam grooves 20*b*.

The secondary hammer 21 is formed as a cylindrical member made of steel. A front portion 21*a* of the secondary hammer 21 accommodates the primary hammer 20 therein and has an inner diameter larger than that of a rear portion 21*b* thereof. An end portion of the front portion 21*a* is fixed with a cover 25 of a ring shape. The rear portion 21*b* of the secondary hammer 21 has an inner diameter smaller than that of the front portion 21*a* and an end portion of the rear portion 21*b* is press-fitted in an outer ring 24*a* of a rolling bearing 24. An inner peripheral surface of the rear portion 21*b* is formed with a ring-shaped supporting portion 21*e* and a rear surface of the ring-shaped supporting portion 21*e* abuts against the rolling bearing 24.

The secondary hammer 21 and the primary hammer 20 include an integral rolling mechanism that integrally rotates. Referring to FIG. 2, the primary hammer 20 includes four first pin grooves 20*d* parallel to the axis of rotation of the spindle 11 on the outer peripheral surface thereof. A cross-section of the first pin groove 20*d* is semicircular. The secondary hammer 21 includes four second pin grooves 21*c* parallel to the axis of rotation of the spindle 11 on an inner peripheral surface of the front portion 21*a*. A cross-section of the second pin groove 21*c* is semicircular. The four second pin grooves 21*c* of the secondary hammer 21 are formed at positions corresponding to the four first pin grooves 20*d* of the primary hammer 20. The first pin grooves 20*d* may be formed on the outer peripheral surface of the primary hammer 20 at intervals of 90 degrees. The second pin grooves 21*c* are formed on the inner peripheral surface of the secondary hammer 21 at intervals of 90 degrees.

In the second pin groove 21*c* an engaging pin 26 that is a columnar member is disposed. The engaging pin 26 may be a needle roller. The engaging pin 26 is inserted in the second pin groove 21*c* from a front end side of the secondary hammer 21 to a bottom portion of the groove. While the engaging pin 26 is inserted to the groove bottom portion, an elastic member 27 having a function of preventing falling of the engaging pin 26 is attached to an annular groove 21*d* formed on the inner peripheral surface of the secondary hammer 21. Disposing the elastic member 27 in the annular groove 21*d* limits movement of the engaging pin 26 in the second pin groove 21*c*. The function of preventing falling of the engaging pin 26 of the elastic member 27 will be described later.

Upon assembling, the primary hammer 20 is inserted into the secondary hammer 21 such that the four first pin grooves 20*d* of the primary hammer 20 are engaged with the four engaging pins 26 while the four engaging pins 26 are attached to the four second pin grooves 21*c* of the secondary hammer 21. This allows the primary hammer 20 and the secondary hammer 21 to integrally rotate about the axis of rotation of the spindle 11. The primary hammer 20 is also allowed to move forward and backward guided by the engaging pins 26 and thus is enabled to apply rotary stroke force to the anvil 22.

The primary hammer 20 includes an annular recessed portion 20*c* on a rear side thereof. The spring member 23 is disposed between the recessed portion 20*c* of the primary hammer 20 and the ring-shaped supporting portion 21*e* of the secondary hammer 21. This allows the primary hammer 20, the secondary hammer 21, and the spring member 23 to integrally rotate about the axis of rotation of the spindle 11.

The anvil 22 engaged with the primary hammer 20 is made of steel and is supported by the front housing 2*a* in a freely rotatable manner via a sliding bearing 28 made of steel or brass as illustrated in FIG. 1. A tip of the anvil 22 includes a tool mounting portion 22*a* having a rectangular cross-section for attaching a socket body thereto. The socket body is for mounting a head portion of a hexagon bolt or a hexagon nut thereto.

A rear portion of the anvil 22 includes a pair of nails 22*b* engaged with the pair of nails 20*a* of the primary hammer 20. Each of the pair of nails 22*b* is formed into a fan shape and an outer peripheral surface thereof may be in contact with an inner peripheral surface of a front end portion of the secondary hammer 21. The pair of nails 22*b* has a function to hold the center of rotation upon rotation of the secondary hammer 21. Note that the nails 22*b* of the anvil 22 and the nails 20*a* of the primary hammer 20 may not necessarily be two in number but three or more nails may be included at equivalent intervals in a circumferential direction of the anvil 22 and the primary hammer 20 as long as the same number of nails are included in each of the anvil 22 and the primary hammer 20.

The anvil 22 includes a ring-shaped flange 22*c* formed to be in contact with the pair of nails 22*b*. On an outer peripheral side of the flange 22*c*, a cover 25 to cover an open end of the front portion 21*a* of the secondary hammer 21 is disposed. An O ring 29 is disposed between the cover 25 and the sliding bearing 28 to prevent generating a space between the cover 25 and the secondary hammer 21. The hole 22*d* of the anvil 22 is rotatably inserted with the projection portion 11*c* of the spindle 11.

Next, action of the impact rotary tool 1 of the embodiment will be described.

When a user pulls the operation switch 4 the driver 10 is driven to rotate. Rotation decelerated by the power transmission mechanism 12 is then transferred to the spindle 11 and the spindle 11 thereby rotates. Turning force of the spindle 11 is transferred to the primary hammer 20 via the steel balls 19 fitted between the first cam grooves 11*d* of the spindle 11 and the second cam grooves 20*b* of the primary hammer 20.

Figure 3B:
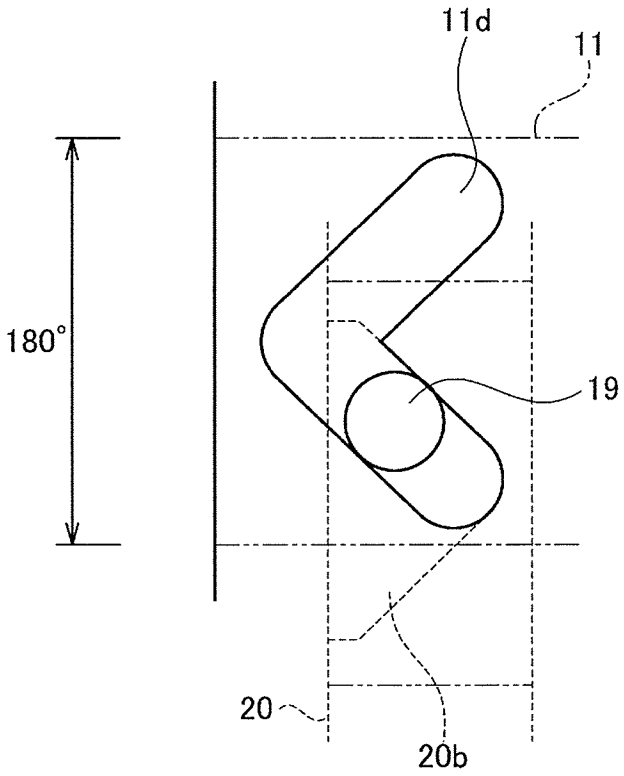
FIGS. 3A and 3B are diagrams illustrating positional relation between a first cam groove and a second cam groove.
Figure 3A:
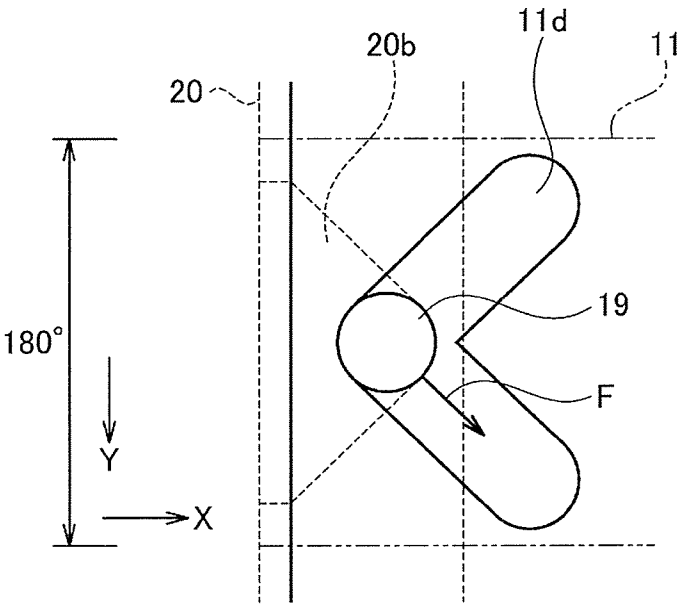
Figure 4A:
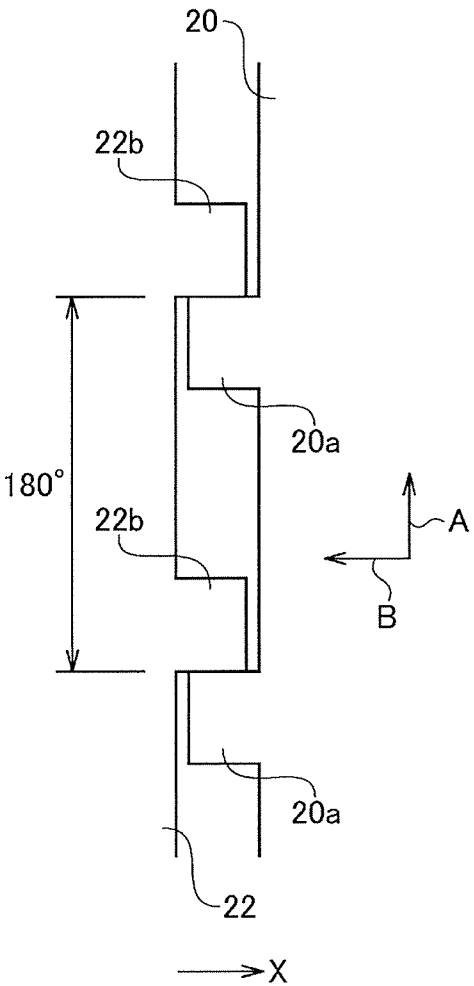
FIGS. 4A to 4C are diagrams illustrating positional relation when engaging surfaces of a primary hammer and an anvil are schematically developed in a circumferential direction.
Figure 4B:
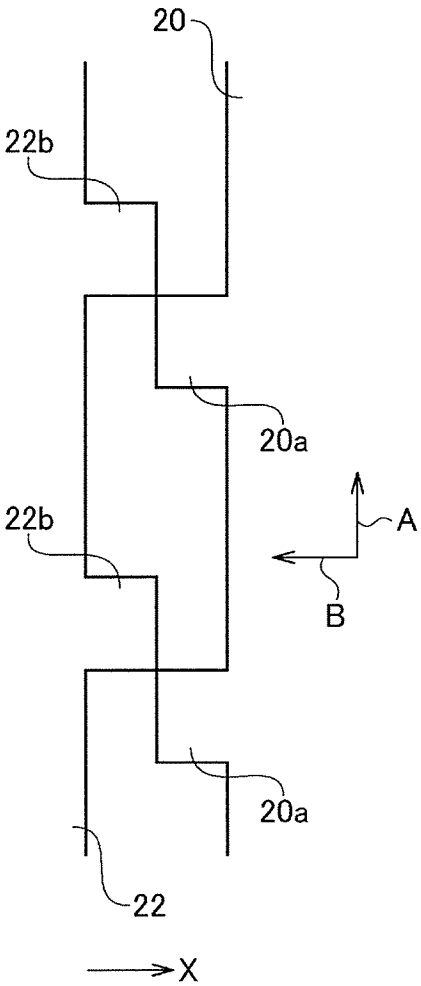
Figure 4C:
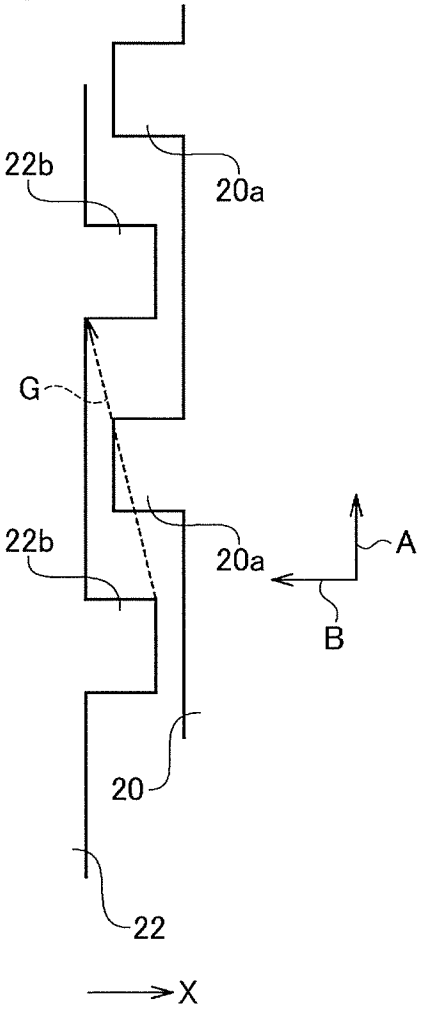

FIG. 3A is a diagram illustrating positional relation between the first cam groove 11*d* and the second cam groove 20*b* immediately after initiation of fastening of a bolt or a nut. FIG. 3B is a diagram illustrating positional relation between the first cam groove 11*d* and the second cam groove 20*b* after elapse of time after initiation of fastening of the bolt or the nut. FIGS. 4A to 4C are diagrams illustrating positional relation when engaging surfaces of the primary hammer 20 and the anvil 22 are schematically developed in a circumferential direction. FIG. 4A is a diagram illustrating an engaged state of the nails 20*a* of the primary hammer 20 and the nails 22*b* of the anvil 22 immediately after initiation of fastening of a bolt or a nut.

As illustrated in FIGS. 4A to 4C, the primary hammer 20 is applied with turning force A in a direction illustrated by an arrow attributable to rotation of the driver 10. The primary hammer 20 is also applied with forward energizing force B, in a direction illustrated by an arrow, attributable to the spring member 23. A buffer member 30 is provided between the primary hammer 20 and the anvil 22. FIG. 4A illustrates a state where the primary hammer 20 and the anvil 22 face each other with a space therebetween due to the buffer member 30.

When the primary hammer 20 and the secondary hammer 21 integrally rotate, the anvil 22 rotates due to engagement of the nails 20*a* of the primary hammer 20 and the nails 22*b* of the anvil 22 and turning force of the primary hammer 20 is transferred to the anvil 22. Rotation of the anvil 22 results in rotation of the socket body (not illustrated) attached to the tool mounting portion 22*a* of the anvil 22, thereby applying turning force to the bolt or the nut and performing initial fastening. Since the spring member 23 applies energizing force B to the primary hammer 20, the steel ball 19 is positioned at the frontmost portion in the first cam groove 11*d* as illustrated in FIG. 3A. Here the nails 20*a* and the nails 22*b* are engaged with the maximum engaging length.

When load torque applied to the anvil 22 increases as fastening of the bolt or the nut proceeds, turning force in a Y direction is generated in the primary hammer 20. When the load torque exceeds a predetermined value, the steel ball 19 moves in a direction illustrated by an arrow F along inclined surfaces of the first cam groove 11*d* and the second cam groove 20*b* against the energizing force B by the spring member 23, thereby moving in a direction (X direction) where the primary hammer 20 recedes.

When the steel ball 19 moves in the direction illustrated by the arrow F by a predetermined amount and the primary hammer 20 moves by the maximum engaging length of the nails 20*a* of the primary hammer 20 and the nails 22*b* of the anvil 22 in the X direction as illustrated in FIG. 3B, engagement of the nails 20*a* and the nails 22*b* is canceled as illustrated in FIG. 4B.

When the nails 20*a* come off the nails 22*b*, the energizing force B of the compressed spring member 23 is released and thus the primary hammer 20 proceeds forward by the energizing force B while rotating at a high speed in a direction in which the turning force A is applied.

Then the nails 20*a* of the primary hammer 20 move along a trajectory illustrated by an arrow G, collide with the nails 22*b* of the anvil 22, and apply stroke force to the anvil 22 in the rotation direction as illustrated in FIG. 4C. Thereafter the nails 20*a* of the primary hammer 20 moves in a direction opposite to the trajectory G due to reaction; however, the nails 20*a* ultimately return to the state illustrated in FIG. 4A due to the turning force A and the energizing force B. The above actions are repeated and rotary stroke force by the primary hammer 20 is thereby repeatedly applied to the anvil 22.

Note that the above is descriptions for actions upon fastening a bolt or a nut; substantially similar actions to those of fastening are performed by the rotary stroke mechanism also upon loosening the fastened bolt or the nut. In this case, rotating the driver 10 in a direction opposite to that of fastening allows the steel ball 19 to move to an upper right side along the first cam groove 11*d* illustrated in FIG. 3A. The nails 20*a* of the primary hammer 20 thereby strike the nails 22*b* of the anvil 22 in the direction opposite to that of fastening.

Next, actions of the secondary hammer 21 upon rotary stroke will be described with comparison to an impact rotary tool not including a secondary hammer.

When engagement of the nails 20*a* of the primary hammer 20 and the nails 22*b* of the anvil 22 is canceled, the spring member 23 is released from the compressed state and energy accumulated in the spring member 23 is released as kinetic energy of the primary hammer 20 and the secondary hammer 21.

The primary hammer 20 proceeds forward while rotating at high speed as illustrated by the trajectory G in FIG. 4C. The nails 20*a* of the primary hammer 20 collide with the nails 22*b* of the anvil 22, thereby applying stroke force to the anvil 22 in the rotation direction. Concurrently, a front end surface of the primary hammer 20 collides with a rear end surface of the anvil 22, thereby applying stroke force to the anvil 22 in the axial direction. Striking on the anvil 22 by the primary hammer 20 is performed 40 times per second for example. The stroke impact generates vibration in a direction perpendicular to the axis of the spindle 11 and in the axial direction of the spindle 11.

The vibration causes fatigue to a user and thus is desired to be small as possible. Of these types of vibration, the vibration in the axial direction of the spindle 11 is generated by stroke impact in the axial direction applied to the anvil 22. This stroke impact in the axial direction does not contribute to fastening of the bolt or the nut.

The strength of impact in the axial direction by a hammer is proportional to the mass of the hammer and the strength of impact in the rotation direction is proportional to moment of inertia (a total sum of products of the mass of parts in an object multiplied by squared distances from those parts to an axis of rotation) of the hammer.

When rotary stroke is applied to the anvil 22 using a single hammer, it is desired that the mass of the hammer is reduced in order to reduce the impact in the axial direction. When the mass of the hammer is simply reduced, however, the moment of inertia decreases and thus the impact in the rotation direction also decreases. Rotary stroke force applied to the anvil 22 is thus reduced. The impact rotary tool 1 of the embodiment therefore solves the aforementioned issues by using the secondary hammer 21 that integrally rotates with the primary hammer 20 but does not move in the axial direction of the spindle 11 separately from the primary hammer 20 that strikes the anvil 22.

Specifically, a double hammer configuration is employed where total mass of the primary hammer 20 and the secondary hammer 21 is substantially equal to the mass of a case where a single hammer is used and the mass of the secondary hammer 21 is larger than the mass of the primary hammer 20. In this double hammer configuration, the impact force applied in the rotation direction of the anvil 22 is proportional to moment of inertia of the two hammers, that is, total moment of inertia of the primary hammer 20 and the secondary hammer 21.

Meanwhile, impact force applied in the axial direction by the primary hammer 20 and the secondary hammer 21 is proportional to the mass of the primary hammer 20 only. Therefore, allowing the mass of the secondary hammer 21 to be as large as possible as compared to the mass of the primary hammer 20 can secure impact force applied in the rotation direction while reducing the impact force applied in the axial direction.

In the embodiment, the moment of inertia is increased utilizing proportionality of the magnitude of the moment of inertia to a squared radius of rotation. That is, the moment of inertia of the secondary hammer 21 is increased by providing the secondary hammer 21 with greater mass on the outer peripheral side of the primary hammer 20, thereby increasing impact force in the rotation direction by the two hammers.

Therefore, employing the double hammer configuration according to the embodiment allows for implementing the impact rotary tool 1 that allows for increasing the impact force applied in the rotation direction of the anvil 22 and mitigates vibration generated in the axial direction of the spindle 11.

In the above double hammer configuration, the engaging pin 26 engaged with the primary hammer 20 and the secondary hammer 21 has a quite important role. The engaging pin 26 has a function to allow the primary hammer 20 and the secondary hammer 21 to integrally rotate and to allow the primary hammer 20 to move in the direction of the axis of rotation. As described above, the engaging pin 26 is disposed in the second pin groove 21*c* formed in the direction of the axis of rotation on the inner peripheral surface of the secondary hammer 21.

Figure 5B:
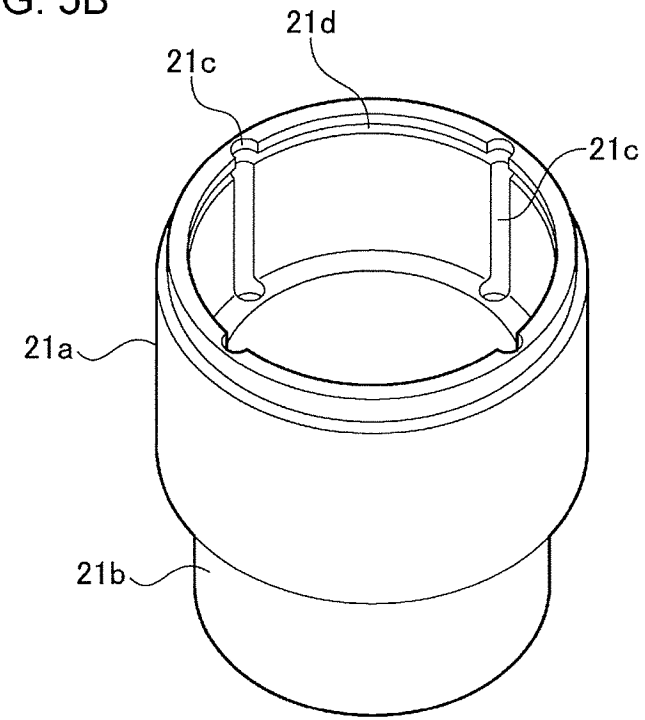
FIG. 5A is a cross-sectional view of a secondary hammer and FIG. 5B is a perspective view of the secondary hammer.
Figure 5A:
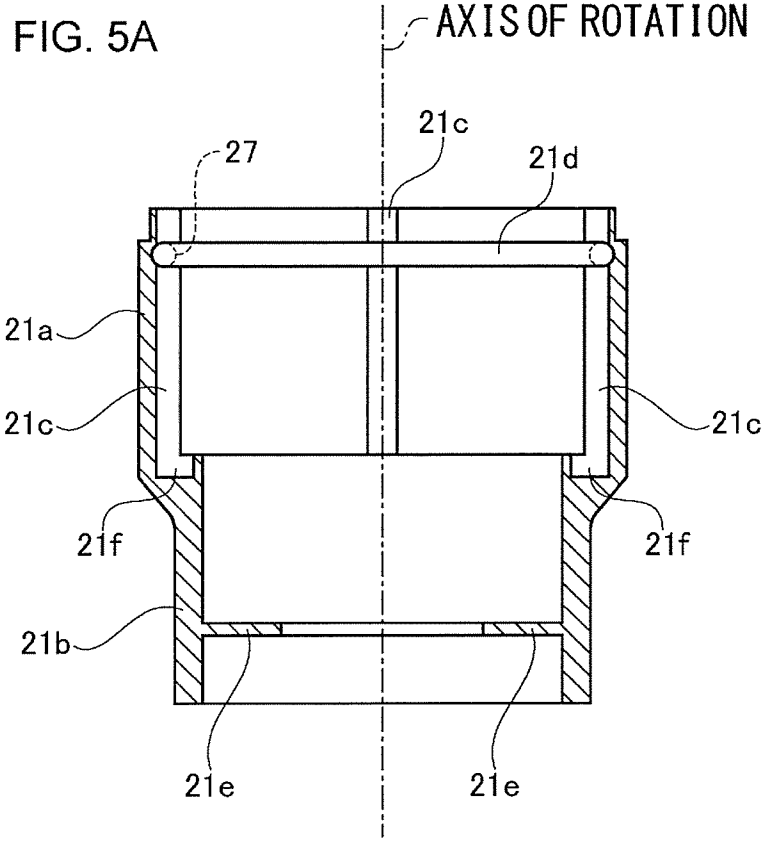

FIG. 5A is a cross-sectional view of the secondary hammer 21 and FIG. 5B is a perspective view of the secondary hammer 21. Four second pin grooves 21*c* are formed in the direction of the axis of rotation on an inner peripheral surface of a front portion 21*a* of the secondary hammer 21. An open end of the second pin groove 21*c* is formed on a front side of the secondary hammer 21. A groove bottom portion 21*f* of the second pin groove 21*c* forms a recessed portion that can receive a rear end portion of the engaging pin 26. When the engaging pin 26 is assembled, the engaging pin 26 is inserted from the front side of the secondary hammer 21 until the rear end portion of the pin reaches the groove bottom portion 21*f*. While the engaging pin 26 is inserted to the groove bottom portion 21*f*, the elastic member 27 is attached to the annular groove 21*d* formed in a circumferential direction on the inner peripheral surface of the front portion 21*a* of the secondary hammer 21.

In the impact rotary tool 1, the primary hammer 20 applies stroke impact to the anvil 22 and thus the engaging pin 26 receives force in the axial direction by the stroke impact by the primary hammer 20. When the engaging pin 26 moves in the second pin groove 21*c* or comes off from the second pin groove 21*c*, the impact rotary tool 1 may have malfunction. It is thus desired that the engaging pin 26 is held at a predetermined position in the second pin groove 21*c*.

In the embodiment, therefore, the elastic member 27 is disposed in the annular groove 21*d* as a member to prevent falling of the engaging pin 26, abuts against a tip portion of the engaging pin 26, and limits movement of the engaging pin 26 toward the open end of the second pin groove 21*c*. The elastic member 27 is formed of a deformable material such as nitrile rubber (NBR).

Using the elastic member 27 as the member to prevent falling of the engaging pin 26 allows for absorbing force transferred to the engaging pin 26 by the stroke impact by the primary hammer 20. Especially in the impact rotary tool 1 of the embodiment, the engaging pin 26 is inserted to the second pin groove 21*c* from the front side of the secondary hammer 21 and thus it is desired that the falling preventing member is disposed near a position where the stroke impact is applied by the primary hammer 20. Compared to a case where the engaging pin 26 is inserted from a rear side of the secondary hammer 21 and the falling preventing member is disposed at the rear end side of the secondary hammer 21, the falling preventing member in the impact rotary tool 1 of the embodiment receives greater force in the axial direction from the engaging pin 26. Therefore, the force in the axial direction applied by the engaging pin 26 is effectively absorbed by allowing the elastic member 27 to be the falling preventing member, thereby stably holding the engaging pin 26 at a predetermined position. Using the deformable elastic member 27 has an advantage of absorbing dimensional error in the longitudinal direction of the engaging pin 26.

The second pin groove 21*c* and the annular groove 21*d* intersect on the inner peripheral surface of the front portion 21*a*.

Figure 6:
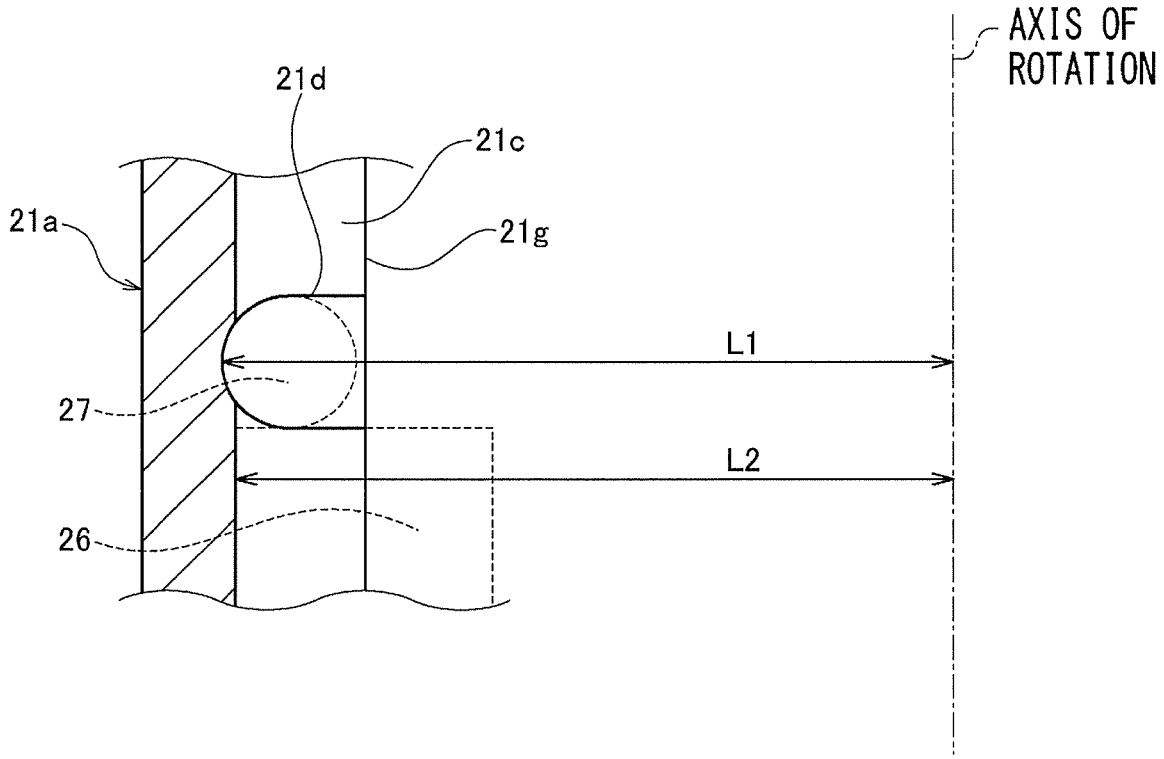
FIG. 6 is an enlarged cross-sectional view of an intersecting point of a second pin groove and an annular groove.

FIG. 6 is an enlarged cross-sectional view of an intersecting point of the second pin groove 21*c* and the annular groove 21*d*. As the intersecting point, the annular groove 21*d* is positioned outward from the second pin groove 21*c* in a radial direction. In FIG. 6, the length L1 is a radius of the outermost periphery of the annular groove 21*d* and the length L2 is the maximum distance between the axis of rotation and the second pin groove 21*c*. Here relation of L1>L2 holds. The outermost portion of the annular groove 21*d* in the radial direction is positioned outward from the outermost portion of the second pin groove 21*c* in the radial direction.

The elastic member 27 has a ring shape and is disposed in the annular groove 21*d*. The elastic member 27 may have a round cross-sectional shape or may have a shape that closely fits a cross-sectional shape of the annular groove 21*d*. Positioning the annular groove 21*d* outward from the second pin groove 21*c* in the radial direction allows the outer peripheral surface of the elastic member 27 to closely fit to the annular groove 21*d* also at the intersecting point of the second pin groove 21*c* and the annular groove 21*d* when the ring-shaped elastic member 27 is disposed in the annular groove 21*d*.

The elastic member 27 is disposed in the annular groove 21*d* without protruding inward from the inner peripheral surface of the secondary hammer 21 where the second pin groove 21*c* is formed. Specifically, the elastic member 27 is disposed in the annular groove 21*d* without protruding inward from an inner peripheral surface 21*g* of the front portion 21*a*. The front portion 21*a* accommodates the primary hammer 20 that moves forward and backward and thus it is desired that the elastic member 27 does not protrude inward from the inner peripheral surface 21*g* to avoid interfering with the primary hammer 20.

It is preferable that an outer diameter of the elastic member 27 having the ring shape is larger than a diameter of the annular groove 21*d*. The elastic member 27 is formed of a deformable material and thus can be fitted in the annular groove 21*d* even though an outer diameter thereof is larger than a diameter of the annular groove 21*d*. Moreover, when the elastic member 27 with a large diameter is fitted in the annular groove 21*d*, the elastic member 27 is disposed in the annular groove 21*d* while applying outward force in the radial direction to the annular groove 21*d* and the elastic member 27 is thus unlikely to come off from the annular groove 21*d*. When the elastic member 27 is formed of a rubber material, it is preferable that the outer diameter of the elastic member 27 is larger than the diameter of the annular groove 21*d* by 5% or more depending on the material. Note that when the outer diameter of the elastic member 27 is overly larger than the diameter of the annular groove 21*d*, assembling property of the elastic member 27 and the annular groove 21*d* is deteriorated. Therefore, it is desired that the outer diameter of the elastic member 27 is set at a length that can be accommodated in the annular groove 21*d* and does not protrude from the inner peripheral surface 21*g* upon accommodation therein.

Figure 7:
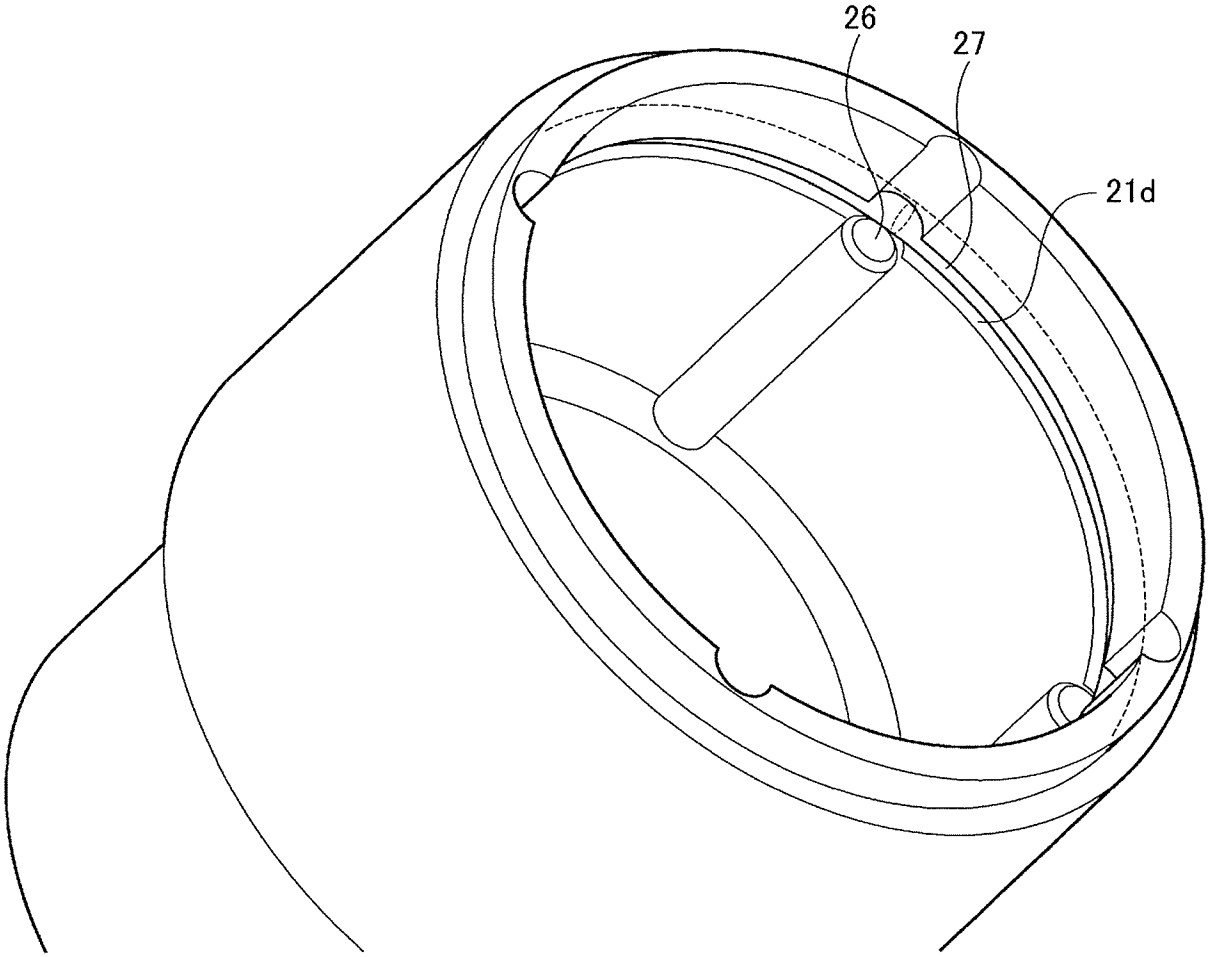
FIG. 7 is a diagram illustrating an elastic member disposed in the annular groove.

FIG. 7 is a diagram illustrating the elastic member 27 disposed in the annular groove 21*d*. The embodiment allows for providing a structure that holds the engaging pin 26 at a predetermined position in a suitable manner by the elastic member 27.

Hereinafter, a case where a C-letter shaped stopper ring made of metal (hereinafter referred to as "C spring") is employed as a falling preventing member will be described as comparative technique to the embodiment. The C spring has flexibility and thus can be fitted in the annular groove 21*d*; however, the strength of a missing part is low. When using the C spring as a falling preventing member, however, it is desired that the missing part is disposed at a position not in contact with the engaging pin 26. The C spring however may rotate in the annular groove 21*d* due to vibration in the rotation direction due to stroke impact by the primary hammer 20 and the missing part of the C spring may be shifted to a position in contact with the engaging pin 26. In this case the engaging pin 26 may apply impact to the missing part and the C spring may break.

Moreover, it is desired that the C spring is formed such that both ends of the missing part are just in contact with each other when the C spring is disposed in the annular groove 21*d*. For this end, however, desirably the length of the C spring is processed with high accuracy. This increases manufacturing cost of the C spring.

On the contrary, as described in the embodiment, when the ring-shaped elastic member 27 is used as the falling preventing member, the outer diameter of the elastic member 27 is only required to be accommodated in the annular groove 21*d* and not to protrude from the inner peripheral surface 21*g* upon accommodation therein. Therefore no strict control on the length is required and manufacturing is possible at low cost. The ring-shaped elastic member 27 includes no missing part and thus any portion thereof has the same strength. Therefore, even when the elastic member 27 rotates in the annular groove 21*d* due to vibration in the rotation direction due to stroke impact by the primary hammer 20, there is no issue related to the strength. Moreover, since a position where the engaging pin 26 abuts against is shifted due to rotational movement in the annular groove 21*d*, fatigue of rubber can be uniform. Using the ring-shaped elastic member 27 as the falling preventing member, therefore, the function of preventing falling can be stably implemented as compared to the case of using the C spring.

An overview of an embodiment of the present invention is as follows.

An impact rotary tool (1) of an embodiment of the present invention includes: a driver (10); a spindle (11) rotated by the driver; a primary hammer (20) rotatable about an axis of rotation of the spindle and movable in a direction of the axis of rotation; a secondary hammer (21) accommodating the primary hammer and rotatable integrally with the primary hammer; and an anvil (22) applied with rotary stroke force by the primary hammer. The impact rotary tool (1) includes an engaging pin (26) that is engaged with the primary hammer and the secondary hammer, integrally rotates the primary hammer and the secondary hammer, and allows the primary hammer to move in the direction of the axis of rotation and an elastic member (27) that limits movement of the engaging pin.

The engaging pin (26) may be disposed in a first groove portion (21*c*) formed in the direction of the axis of rotation on an inner peripheral surface of the secondary hammer and the elastic member (27) may be disposed in a second groove portion (21*d*) formed in a circumferential direction on the inner peripheral surface of the secondary hammer. It is preferable that the first groove portion (21*c*) and the second groove portion (21*d*) intersect on the inner peripheral surface of the secondary hammer and that the second groove portion is positioned outward from the first groove portion in a radial direction at the intersecting point.

It is preferable that an open end of the first groove portion (21*c*) is formed on a front side of the secondary hammer (21) and that the elastic member (27) abuts against an end portion of the engaging pin (26) and limits movement of the engaging pin toward the open end of the first groove portion.

It is preferable that the elastic member (27) has a ring shape and is disposed in the second groove portion (21*d*). It is preferable that an outer diameter of the elastic member having the ring shape is larger than a diameter of the second groove portion. It is preferable that the elastic member (27) is disposed in the second groove portion (21*d*) without protruding inward from the inner peripheral surface of the secondary hammer where the second groove portion is formed.

One aspect of the present invention has been described above based on the embodiments. These embodiments are merely examples. Therefore, it should be understood by a person skilled in the art that combinations of the components or processing processes of the examples may include various variations and that such a variation is also within the scope of the present teachings.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An impact rotary tool, comprising:

a driver;

a spindle rotated by the driver;

a primary hammer rotatable about an axis of rotation of the spindle and movable in a direction of the axis of rotation;

a secondary hammer accommodating the primary hammer and rotatable integrally with the primary hammer; and an anvil on which the primary hammer applies a rotary stroke force, wherein the impact rotary tool further comprises:

an engaging pin that is engaged with the primary hammer and the secondary hammer, integrally rotates with the primary hammer and the secondary hammer, and allows the primary hammer to move in the direction of the axis of rotation; and an elastic member that limits movement of the engaging pin, wherein a first groove portion is formed in a direction parallel to the axis of rotation on an inner peripheral surface of the secondary hammer and a second groove portion is formed in a circumferential direction on the inner peripheral surface of the secondary hammer, an open end of the first groove portion is formed on a front side of the secondary hammer and a recessed portion is formed on a rear end of the first groove portion, the engaging pin is inserted into the first groove portion from the front side of the secondary hammer and a rear end portion of the engaging pin is received by the recessed portion, and the elastic member is disposed in the second groove portion and abuts against a front end portion of the engaging pin and limits movement of the engaging pin toward the open end of the first groove portion.

2. The impact rotary tool according to claim 1, wherein the first groove portion and the second groove portion intersect, at an intersecting point, on the inner peripheral surface of the secondary hammer, and the second groove portion is positioned outward from the first groove portion in a radial direction at the intersecting point.

3. The impact rotary tool according to claim 1, wherein the elastic member has a ring shape.

4. The impact rotary tool according to claim 3, wherein an outer diameter of the elastic member having the ring shape is larger than a diameter of the second groove portion.

5. The impact rotary tool according to claim 1, wherein the elastic member is disposed in the second groove portion without protruding inward from the inner peripheral surface of the secondary hammer on which the second groove portion is formed.

* * * * *